US005265650A

United States Patent [19]

Vinciguerra

[11] Patent Number: 5,265,650

[45] Date of Patent: Nov. 30, 1993

[54] POSITION SENSOR FOR AN ELECTRONIC ROTARY DOBBY

[75] Inventor: Costantino Vinciguerra, Florence, Italy

[73] Assignee: Nuovopignone-Industrie Meccaniche e Fonderia SpA, Florence, Italy

[21] Appl. No.: 972,534

[22] Filed: Nov. 6, 1992

[30] Foreign Application Priority Data

Nov. 15, 1991 [IT] Italy ..... MI91 A 003055

[51] Int. Cl.[5] ..... D03C 1/00

[52] U.S. Cl. ..... 139/337; 139/66 R; 139/76

[58] Field of Search ..... 139/83, 84, 66 R, 76, 139/337, 338

[56] References Cited

U.S. PATENT DOCUMENTS 4,441,528 4/1984 Julich ..... 139/76
4,452,281 6/1984 Speich ..... 139/76

FOREIGN PATENT DOCUMENTS 0082906 7/1983 European Pat. Off. .
2530678 1/1984 France .
2001401 1/1979 United Kingdom .

*Primary Examiner*—Andrew M. Falik
*Attorney, Agent, or Firm*—Morgan & Finnegan

[57] ABSTRACT

An automatic control system for an electronic rotary dobby, has a pair of permanent magnets mounted on each of the corresponding rocker members. These members are driven by the dobby operating crank arms, such as the ends of the main levers. The magnets on the pair mounted on the rocker members are arranged such that in one end-of-rock position of the respective rocker member only one magnet cooperates with a related fixed sensor, and in the other end-of-rock position of the respective rocker member only one magnet cooperates with another related fixed sensor, and in the other end-of-rock position only the other magnet of the pair cooperates with its own fixed sensor. The sensor signals are compared with the corresponding signals of the predetermined weaving program, the loom being halted if they do not coincide.

5 Claims, 1 Drawing Sheet

POSITION SENSOR FOR AN ELECTRONIC ROTARY DOBBY

BACKGROUND OF THE INVENTION

1. Field of the Invention

This invention relates to a control system which by economically checking on a continuous basis at each beat of the loom that the dobby has effectively accomplished that for which it is programmed, ensures a weave free from any defect without the need for visually inspecting the formed fabric, and provides immediate and hence damage-free stoppage of the loom-dobby unit if any dobby components undergo breakage.

2. Description of the Related Art (Including information disclosed under 37 C.F.R. §§1.97–1.99)

As is well known, a predetermined program is used to produce in dobbies a certain succession of movements which form a desired pattern by suitably operating the loom heddle frames.

In electronic rotary dobbies the reliability of the electronic circuit and the electromagnetic systems used is currently very high to the extent of practically guaranteeing the execution of the required operations. If however for any reason a dobby operation is performed incorrectly, which does indeed happen but only very rarely, this inevitably results in a defect in the produced fabric which may be difficult to identify on visual inspection by the operator.

Hence the current absence of any automatic control system in dobbies not only means that the constant costly presence of an operator is required, but in addition that reliable and immediate identification of the defect in the fabric cannot be achieved and hence that fabrics guaranteed free of defects cannot be obtained, and moreover immediate stoppage of the loom when mechanical breakages occur cannot be ensured, with the result that further serious damage can take place.

Automatic control systems have not been used up to the present time on looms both for constructional reasons in that dobbies have an axial pitch of 12 millimeters with up to twenty controls per dobby, and for reasons of cost and reliability.

SUMMARY OF THE INVENTION

The object of the present invention is to obviate said drawbacks by providing a highly reliable automatic control system which is so economical as not to appreciably influence the dobby cost.

This is substantially attained in that on each of corresponding rocker members or main levers driven by the crank arms which operate the dobby, for example the free end of the main levers, there is mounted a pair of permanent magnets arranged such that in one of the two end-of-rock positions of said rocker member, corresponding to the heddle frame lowered, one of said magnets cooperates with a sensor, for example of Hall effect type, and in the other end-of-rock position, corresponding to the heddle frame raised, the other magnet of the pair cooperates with its corresponding sensor, for example again of Hall effect type, said two sensors being fixedly supported by an amagnetic support and being connected to the dobby logic unit, which is adapted to compare, at said two end-of-rock positions and at a third position between these latter, the signals of said sensors with the corresponding signals of the predetermined weaving program, and to halt the loom if said compared signals do not coincide.

In this manner, using simple low-cost components not only are the weaving process and the dobby mechanical system subjected to effective, reliable and continuous control, but in addition the reading obtained in said third position when compared with the previous position's reading and with the subsequent data of the weaving program actually enables anticipated information to be obtained on the correctness of operation at the beginning of a rocking movement, i.e. before the relative end position has been reached by the rocking member, so allowing maximum speed of intervention.

Again, in order to screen the individual permanent magnets so that their magnetic flux is directed to involve only the corresponding sensors and hence prevent any influence on the adjacent sensors relative to other magnets, in the light of the fact that as is well known the pairs of magnets are necessarily spaced apart by the standard pitch of 12 millimeters, each magnet is supported embedded in a support element of amagnetic material, preferably plastics material, which extends beyond the metal part of the rocker member on which it is to be fixed, in the direction of the respective sensor. In this manner, said extension of the amagnetic support nullifies the pulling effect on the lines of flux by the rocker member of ferrous material, so enabling the beam of flux lines from the permanent magnet to extend towards the respective sensor.

Hence, the automatic control system for an electronic rotary dobby comprising a series of operating crank arms equal in number to the number of heddle frames in the loom. The crank arms are controlled by a logic unit via a predetermined weaving program and either rock or do not rock a corresponding series of main levers which act on said loom heddle frames via respective lever systems. The control system is characterised, according to the present invention by consisting of a pair of permanent magnets mounted on each of corresponding rocker members that are driven by said operating crank arms. These magnets, of the pair being supported each embedded in a support element of amagnetic material which extends beyond the metal part of said rocker member on which it is to be fixed, in the direction of the respective sensor. These magnets, moreover, are arranged such that in one of the two end-of-rock positions of said rocker member, corresponding to the heddle frame lowered, only one of said magnets of the pair cooperates with said corresponding sensor. In the other end-of-rock position, corresponding to the heddle frame raised, only the other magnet of the pair cooperates with its corresponding sensor, the two said sensors being fixedly supported by an amagnetic support and being connected to said dobby logic unit. The dobby logic unit is adapted to compare, at said two end-of-rock positions and at a third position between these latter, the signals of said sensors with the corresponding signals of the predetermined weaving program, and to halt the loom if said compared signals do not coincide.

According to a preferred application of the present invention, the permanent magnets used are constructed of rare earths, preferably neodymium, iron and bromine, which produce maximum directionality and distance of the magnetic flux towards the sensors. The invention is further clarified hereinafter with reference to the accompanying drawing, which illustrates a preferred embodiment thereof by way of non-limiting example in that technical, constructional or applicational modifications can be made thereto without leaving the scope of the present invention.

DESCRIPTION OF THE PREFERRED EMBODIMENT

Figure 1:
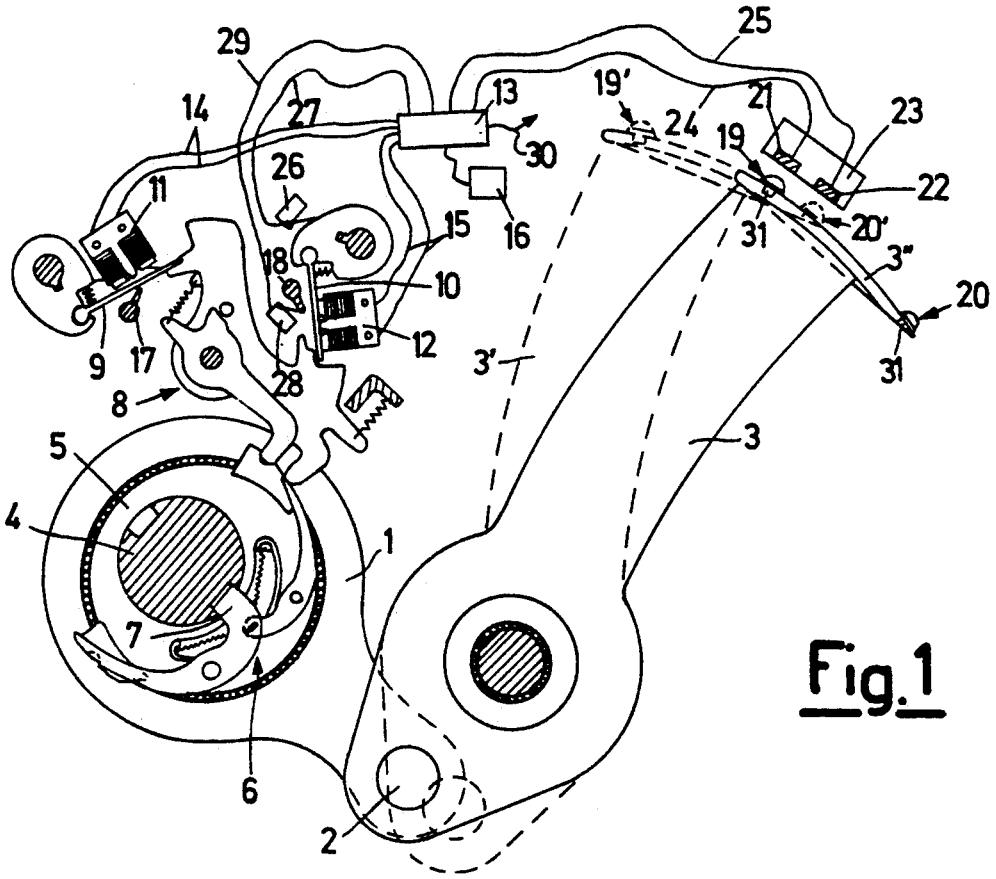
In FIG. 1 is a partial side sectional view of an electronic rotary dobby using the automatic control system according to the invention.

With reference to the figures and to our preceding U.S. patent application Ser. No. 07/920,128 filed on Jul. 24, 1992, the reference numeral 1 indicates one of a series of dobby operating crank arms (the others are practically underlying) which is hinged at 2 to the respective main lever 3 and is mounted idly on the drive shaft 4 via a cam 5 which is either rigidly connected or not connected to said drive shaft 4 by a lever mechanism 6 for moving the key 7, this mechanism being pivoted on said cam and controlled by an operating unit 8 which is made to rock by a cam system, not shown in the figure, operated by striker rods 9 and 10 respectively. Said striker rods 9 and 10 are rocked by a cam system, not shown in the figure, and are rendered effective or non-effective by the electromagnets, 11 and 12 respectively, which are energized by the logic unit 13, to which they are connected by the connections 14 and 15, on the basis of the predetermined weaving program 16, said striker rods being urged against said electromagnets by accompanying arms 17 and 18 respectively, also driven by cam systems not shown in the figure.

On the free end 3'' of each main lever 3 there is mounted a pair of permanent magnets 19 and 20 forming part of the automatic control system of the invention, said magnets being arranged such that when the lever 3 is in its end-of-rock position indicated by full lines in FIG. 1, only the magnet 19 cooperates with the corresponding Hall effect sensor 21, whereas when in its other end-of-rock position indicated by 3' and shown by dashed lines in FIG. 1, only the other magnet 20' cooperates with the corresponding Hall effect sensor 22. The two said sensors 21 and 22 are fixedly supported by an amagnetic support 23 fixed to the dobby body and are connected by cables, 24 and 25 respectively, to said logic unit 13 which compares their signals with those of the weaving program 16 when the main lever 3 is in its end-of-rock positions as sensed by the microswitch 26, which is connected by the connection 27 to the logic unit 13 and senses the movement of the striker rod support which always occurs at the end of the rocking movements, and also when in an intermediate position as sensed by a microswitch 28, which is connected to the logic unit 13 by the cable 29 and senses the movement of the accompanying arm 18 which always occurs immediately after the commencement of the rocking movement, and if these do not coincide it feeds a loom halt signal through the cable 30.

Figure 2:
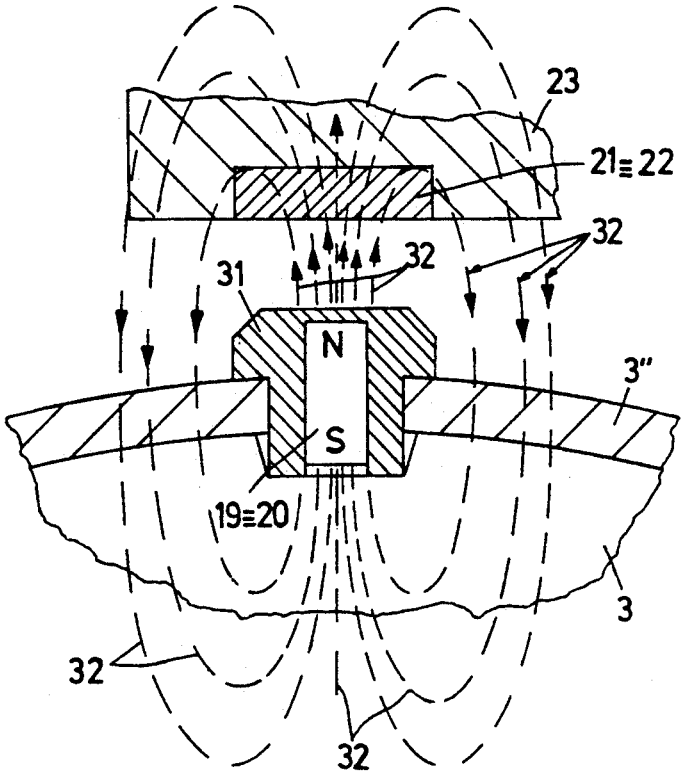
FIG. 2 is a sectional view to a greatly increased scale of a detail of the automatic control system of FIG. 1.

Each permanent magnet 19 or 20 is supported by the lever end 3'', embedded in a support element 31 (see specifically FIG. 2) of amagnetic material, such as plastics material, which extends beyond the metal edges of said end 3'' so that the lines of flux 32 do not immediately close onto said metal edge but are projected towards the relative sensor 21 or 22, which can hence be positioned at a greater distance from the edge 3'' of the main lever.

I claim:

1. For a loom, an automatic control system for an electronic rotary dobby comprising:

a dobby body;

a series of operating crank arms controlled by a logic unit via a predetermined weaving program and being equal in number to the number of heddle frames in the loom;

a corresponding series of main levers which are drivingly connected to the crank arms at one end so as to be rocked to two end-of-rock positions and a position therebetween and which are adapted to act on said heddle frames via respective lever systems;

a pair of permanent magnets mounted on each of the corresponding main levers;

the main levers each having a metal part thereon;

said magnets supported in a support element of amagnetic material which extends beyond the metal part;

a pair of sensors fixed to the dobby body and each of said sensors corresponding to a respective one of said permanent magnets, said magnets being mounted on said main levers such that in one of the two end-of-rock positions of said main lever corresponding to the heddle frame lowered, only one of said magnets of the pair cooperates with said corresponding sensor, and in the other end-of-rock position, corresponding to the heddle frame raised, only the other magnet of the pair cooperates with its corresponding sensor, the two said sensors being fixedly supported by an amagnetic support and being connected to said dobby logic unit, which is adapted to compare, at said two end-of-rock positions and at said third position between these latter, the signals of said sensors with the corresponding signals of the predetermined weaving program, and to halt the loom if said compared signals do not coincide.

2. An automatic control system for a rotary dobby as claimed in claim 1 characterized in that the other end of the main lever is a free end on which is mounted one of said magnets of said pair of permanent magnets.

3. An automatic control system for a rotary dobby as claimed in claim 1, characterized in that said amagnetic support elements in which said permanent magnets are embedded is a plastic material.

4. An automatic control system for a rotary dobby as claimed in claim 1, characterized in that said sensors are Hall effect sensors.

5. An automatic control system for a rotary dobby as claimed in claim 1, characterized in that said permanent magnets are made of materials that are selected from the group consisting of rare earths, neodymium, iron and bromine.

* * * * *